US010301060B2

(12) United States Patent
Strekowski et al.

(10) Patent No.: US 10,301,060 B2
(45) Date of Patent: May 28, 2019

(54) RETAIL PRODUCT PACKAGE

(71) Applicant: Incipio, LLC, Irvine, CA (US)

(72) Inventors: Tomasz Strekowski, Rowland Heights, CA (US); Andy Fathollahi, Corona Del Mar, CA (US)

(73) Assignee: Incipio, LLC, Irvine, CA (US)

( * ) Notice: Subject to any disclaimer, the term of this patent is extended or adjusted under 35 U.S.C. 154(b) by 233 days.

(21) Appl. No.: 15/143,341

(22) Filed: Apr. 29, 2016

(65) Prior Publication Data

US 2017/0313467 A1 Nov. 2, 2017

(51) Int. Cl.

| | |
|---|---|
| ***B65D 25/54*** | (2006.01) |
| ***B65D 5/38*** | (2006.01) |
| ***B65D 5/42*** | (2006.01) |
| ***B65D 77/04*** | (2006.01) |

(52) U.S. Cl.

CPC ..... *B65D 5/38* (2013.01); *B65D 5/4204* (2013.01); *B65D 77/0433* (2013.01); *B65D 2313/04* (2013.01)

(58) Field of Classification Search

CPC ..... B65D 5/38; B65D 5/4204; B65D 25/22; B65D 77/0433; B65D 2313/04

USPC ..... 206/775–778, 461, 468, 806, 818; 229/125.125

See application file for complete search history.

(56) References Cited

U.S. PATENT DOCUMENTS

| | | | | |
|---|---|---|---|---|
| 1,253,489 | A * | 1/1918 | Houghland | B65D 5/38 229/125.125 |
| 3,302,844 | A * | 2/1967 | Warren | B65D 5/38 229/120.18 |
| 4,488,644 | A * | 12/1984 | Wynalda | G11B 23/023 206/248 |
| 5,927,507 | A * | 7/1999 | Shelton | B65D 25/101 206/301 |
| 8,955,671 | B1 * | 2/2015 | Barnett | B65D 25/22 206/1.5 |
| 2003/0047485 | A1 * | 3/2003 | Lux, Jr. | B65D 5/0254 206/778 |
| 2006/0289336 | A1 * | 12/2006 | Ford | B65D 11/12 206/779 |
| 2007/0045136 | A1 * | 3/2007 | Kim | B65D 25/22 206/278 |
| 2007/0193909 | A1 * | 8/2007 | Chin | B65D 43/0202 206/457 |
| 2010/0237140 | A1 | 9/2010 | Becker et al. | |
| 2010/0243507 | A1 | 9/2010 | Gelardi et al. | |
| 2010/0264059 | A1 * | 10/2010 | Jacob Cestari | B65D 5/2009 206/778 |

(Continued)

*Primary Examiner* — Luan K Bui
(74) *Attorney, Agent, or Firm* — Manatt, Phelps & Phillips, LLP

(57) ABSTRACT

A retail product package is disclosed. The package comprises an outer sleeve and an inner tray that is configured to slide in and out of the sleeve. The sleeve and tray being constructed and configured to be magnetically attracted to one another to facilitate and maintain a closed packaging configuration. Windows on the sleeve and tray allow for inspection of the product contained therein, which is mounted via a support element in a fixed position removed from contact from the packaging walls. A hook component is provided on the tray that is configured to extend through a top end wall of the sleeve and facilitate display of the package on a peg in a retail display stand.

21 Claims, 22 Drawing Sheets

(56) References Cited

U.S. PATENT DOCUMENTS

| | | | |
|---|---|---|---|
| 2011/0214396 | A1 | 9/2011 | Franks |
| 2012/0152766 | A1 | 6/2012 | Mazurek |
| 2013/0105480 | A1 | 5/2013 | Zeiss |

* cited by examiner

RETAIL PRODUCT PACKAGE

INCORPORATION BY REFERENCE TO RELATED APPLICATIONS

N/A.

BACKGROUND

Field of the Invention

This patent document relates to package and methods of manufacturing and use therefore, including for example package for protective enclosures and accessories for portable electronic devices and other consumer or retail products.

Description of the Related Art

Package for consumer electronics and accessories therefore, like other consumer products, are often critical to capturing consumer attention and conveying a sense of quality to the consumer. At the same time it is important that such package safe guard the product from damage while also facilitating sales interactions and the particular needs of the retailer, such as being able to present a product not only on standard shelves but also on rowed pegs that extend from display stands.

One conventional package configuration includes and inner tray that holds the product and outer sleeve in which the inner tray is positioned. The outer sleeve completely conceals the product contained therein when the package is fully closed thereby precluding the consumer from inspecting the actual product without removing the tray from the sleeve. The inner tray includes a hook on the top end side that passes through a corresponding opening on the top end side of the outer sleeve so that the package can be hung on a display peg on one end or stood on a shelf on another opposing end. When hung, the force of gravity assists in maintaining the tray within the sleeve in the closed position. When removed from the peg, however, retention of the tray within the sleeve depends on the tolerances between those two components.

The inventors here have found that such tolerances can be difficult to properly control. When the tolerances between the two components are too tight or when the package is damaged, the tray may be difficult to insert or remove from the sleeve. Alternatively, when the tolerances are too loose, the tray may slide out of the sleeve unintentionally. Either situation can be problematic and undermine the consumer experience, increase manufacturing costs, and give rise to product returns arising from damaged package. Moreover, the issues are exacerbated by the fact that the product is concealed from the user when the package is fully closed. Accordingly, it is here recognized that a continued need exists to overcome and improve upon such shortcomings in such conventional product package.

SUMMARY

Various aspects are described in connection with an illustrative implementation of a multi-component product package disclosed herein. The various aspects are disclosed in the written specification including the drawings, and claims, and may be combined to form claims for a device, apparatus, system method of manufacture and/or use in any way, consistent with the teachings herein, without limitation.

The multi-component package comprises uniquely configured and constructed sleeve and tray components. The tray and sleeve components are dimensioned and configured to allow the tray to slide in and out of the sleeve from an open position to a fully closed position. The two components are configured so that they are magnetically attracted to one another to facilitate and maintain a bias toward the closed position. Windows in the sleeve and tray may be provided, in another aspect, to allow for visibility to the product contained therein. In another aspect, a support element may fixedly position the product within the tray component so that the product is spaced apart from the walls of the package and thereby better protected. In further aspects, a hook component may be mounted on the tray component and configured to pass through an aperture in the sleeve so that a retailer may display the package on a conventional display peg. In yet another aspect, Velcro® type fasteners may be employed to maintain the package in a closed position. In yet another aspect, a stop mechanism may be provided to mitigate separation of the tray from the sleeve.

Various alternative implementations of the foregoing aspects are disclosed. The foregoing various aspects may be combined in any manner without limitation.

DETAILED DESCRIPTION OF THE EMBODIMENTS

Figure 1A:
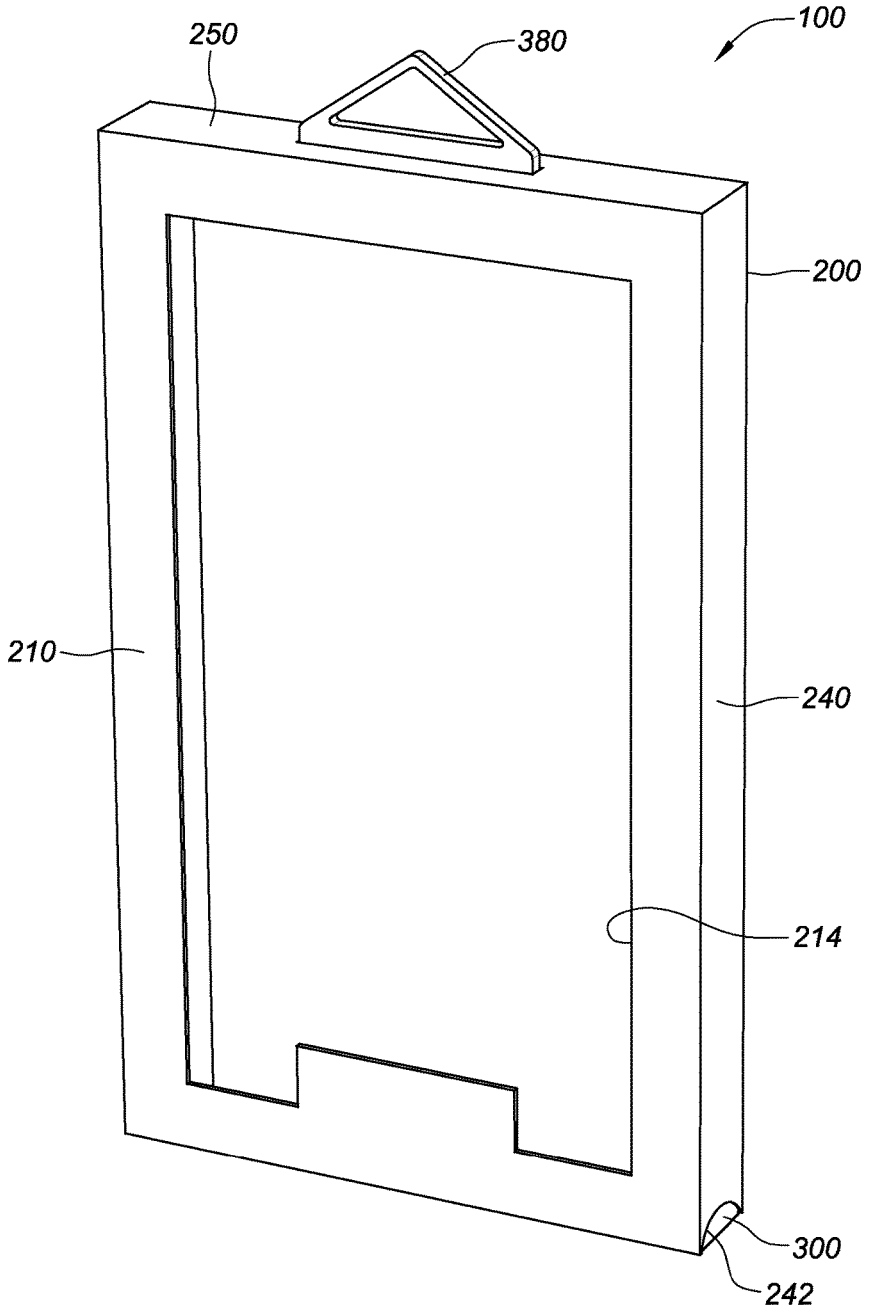
FIG. 1A is a perspective view of an exemplary multi-component package comprising a sleeve and a tray configured for protection and display of a protective case product. The package, as depicted, is in the completely closed position.
Figure 1B:
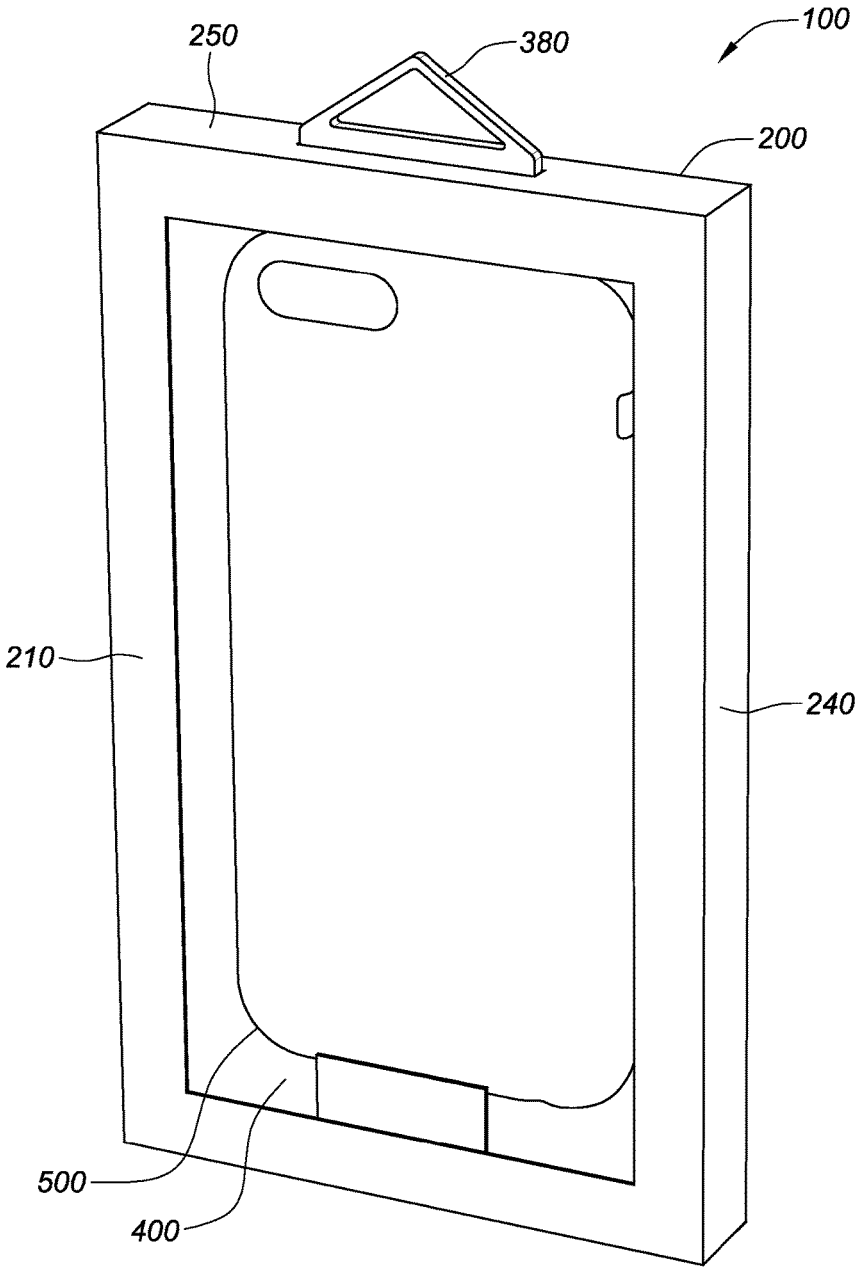
FIG. 1B is a perspective view of the exemplary multi-component package illustrated in FIG. 1A with the protective case included within the package and visible through the front panel window of the sleeve component.
Figure 2A:
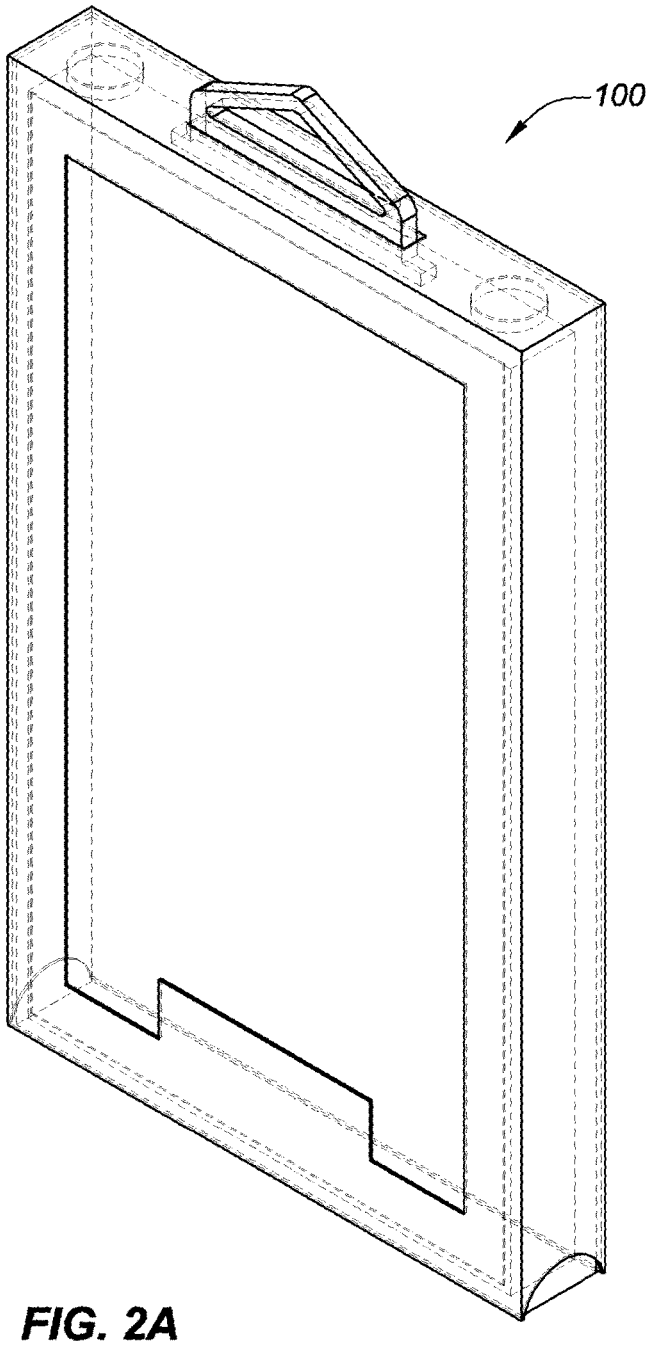
FIGS. 2A-2F are perspective, front, left, right, top and bottom views, respectively, of the multi-component package of FIG. 1A in the fully closed position, wherein concealed portions of the tray are depicted in dashed lines.
Figure 2B:
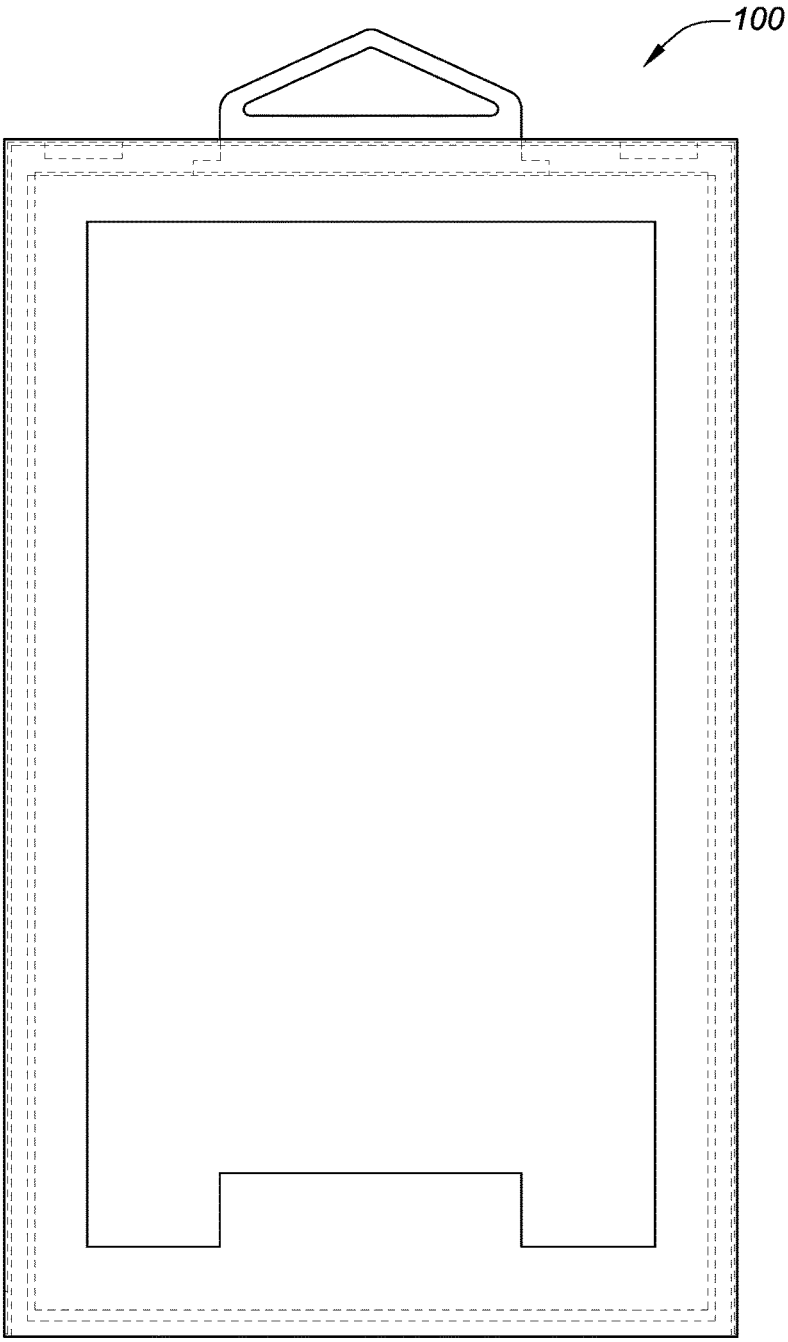
Figure 2C:
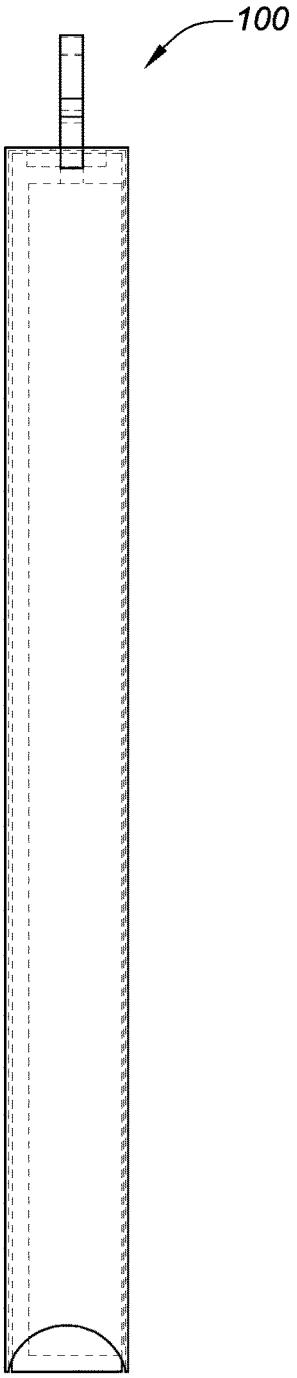
Figure 2D:
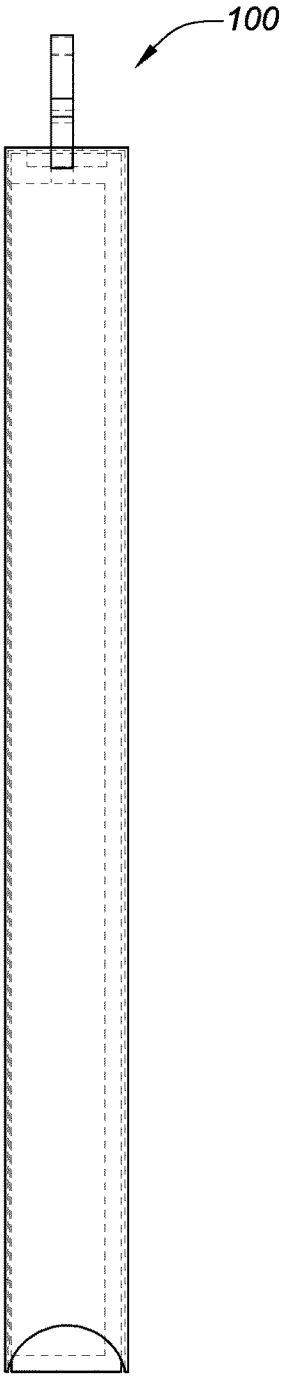
Figure 2E:
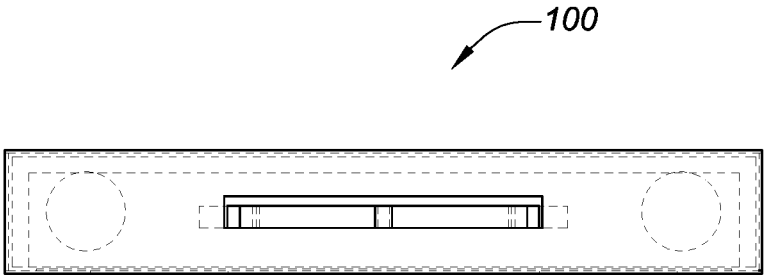
Figure 2F:
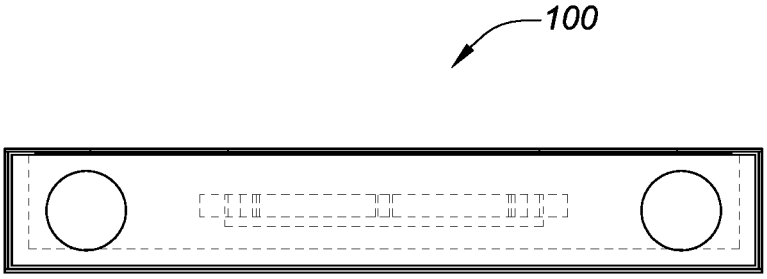

The features, aspects and advantages are described below with reference to the drawings, which are intended to illustrate but not to limit the invention. In the drawings, like reference characters denote corresponding features consistently throughout the drawings. FIGS. 1-7B illustrate various aspects of an embodiment of the multiple-component package 100 for a mobile device protective case product 500. It should be understood, however, that the teachings herein are not limited to any particular product and are applicable to package for other products.

As illustrated in FIGS. 1-7B, the multi-component package 100 is comprised of an outer sleeve component 200, an inner tray component 300 that is dimensioned to slide in and out of bottom end 260 of the compartment 270 that is defined by the walls of the sleeve component 200. The sleeve component 200 is comprised of a front sleeve wall 210 that in the illustrated implementation includes a window 214 to define a front sleeve side, an opposing rear sleeve wall 220 that defines a back sleeve side, left and right opposing sleeve walls 230, 240 that define left and right sleeve sides, a top sleeve wall 250 that defines the top sleeve side and an opposing bottom sleeve side 260 that includes an opening to the sleeve compartment 270 suitably dimensioned to allow the tray 300 to slide in and out therefrom.

The window 214 may be covered or uncovered. When covered, the window 214 may be formed of a clear or transparent glass or polymer panel that is mounted to the internal surface of the front sleeve wall 210 using suitable adhesive, chemical, mechanical agents or connectors and serves allow the customer visibility into the underlying product contents of the sleeve 200. The left and right sleeve sides 230, 240 in the illustrated implementation further include semicircular recessed portions 232, 242 at their respective bottom or lower extents to allow the consumer or sales person to directly engage the underlying tray 300 and thereby facilitate removal of the tray 300 when the tray 300 is fully inserted into the sleeve 200. It should be understood that the recessed cut-out portions may be provided in alternative locations on the sleeve, such as the at the front and/or rear sides.

The tray 300 comprises a front tray wall 310 that defines a front tray side, which in the illustrated implementation includes a tray window 314, an opposing rear tray wall 320 that defines a back tray side, left and right opposing tray walls 330, 340 that define left and right tray sides, a top tray wall 350 that defines the top tray side and an opposing bottom tray wall 360 that defines the bottom tray side. Together the internal surfaces of the tray walls defined a tray compartment 370 wherein the product 500 is positioned.

In the illustrated implementation the tray window 314 is not covered, however, it is contemplated that the tray window 314 may be covered with a clear or transparent glass or polymer panel that is mounted to the front tray wall 310 or other of the tray walls using suitable adhesive, chemical, mechanical agents, connectors or tabs to provide visibility and/or added protection to the underlying product contents contained within the tray 300. It is also contemplated that, in one implementation, the tray window 314 may be covered while the sleeve window 214 is uncovered or vice versa. It is further contemplated that the tray and sleeve windows 314, 214 may be both covered by the same or different materials using any of the noted mounting means. Moreover, one or more of the windows 214, 314 may be covered with a non-transparent covering.

The top tray wall 350 of the tray 300 in the illustrated implementation includes a hook component 380, which may include supporting tabs mounted within a recessed cavity 356 on the internal surface of the top tray wall 350 and an extended region including the operative portion of the hook that can pass through an opening 358 so as to provide a catch that is positioned outside the tray compartment 370. The top sleeve wall 250 includes a corresponding opening 258 therein that is dimensioned to allow the extended region of the hook component 380 to pass through the sleeve 200 when the tray 300 is fully inserted into the sleeve 200. In operation, the hook 380 allows the package 100 to be displayed on a conventional peg display stand. Positioning the hook 380 on the top of the tray 300 and passing it through a slot in the top side of sleeve 200, provides the benefit of allowing gravity to assist in maintaining the package 100 in a fully closed position when the package 100 in hung on a peg.

Figure 7A:
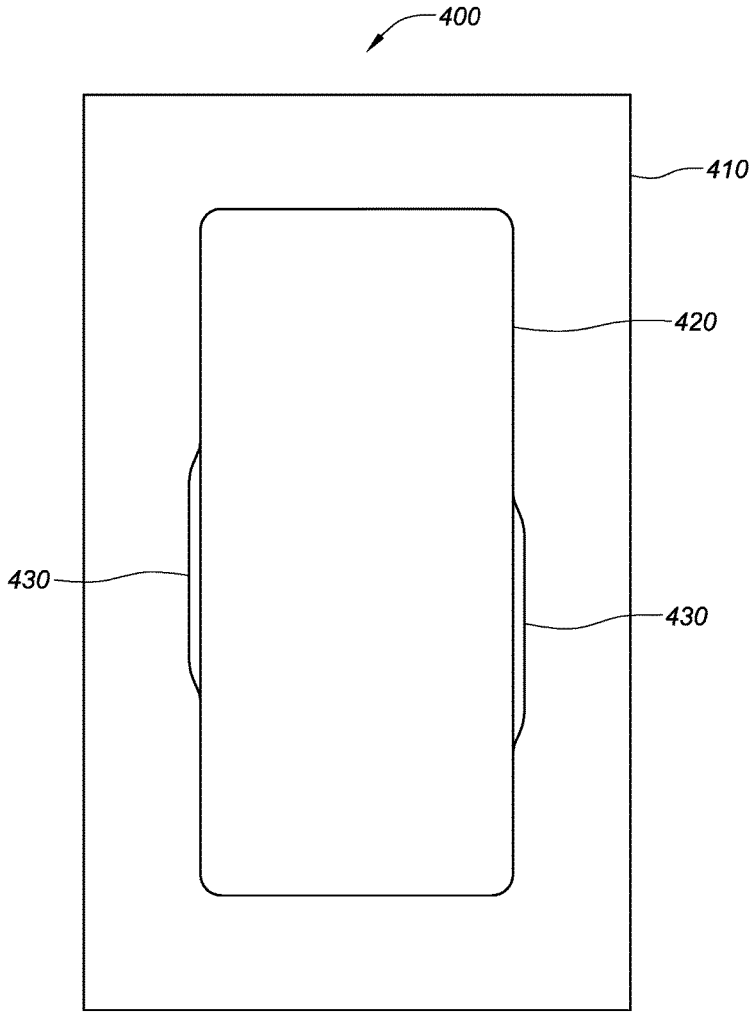
FIGS. 7A-7B illustrate front and side views of a supporting element for the protective case product that is configured to be inserted within the tray component illustrated in FIG. 1A and retain the product within the tray as illustrated in FIG. 1B.
Figure 7B:
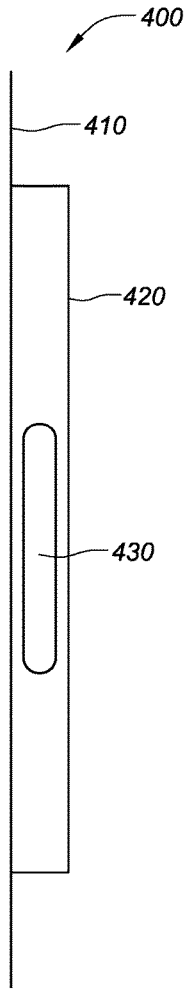

The product 500 may be positioned within the tray compartment 370 by way of a support element 400, best illustrated in FIGS. 7A and 7B, that is dimensioned and sized to fit within the tray 300 and reversibly attach to the product 500 to support the product in a defined static position relative to the tray 300. The support element 400 includes a base portion 410 and an elevated portion 420 that extends outwardly from the base portion 410 and includes and external configurations such as tabs 430 that are dimensioned frictionally engage or otherwise support the product 500 in a fixed position relative to the support element 400. The support element 400 may be mounted within a fixed position relative to the tray 300 via any suitable means including friction fit, adhesive, chemical agent or mechanical connectors. The support element 400 may be a separate component or may be unitarily formed with the tray component 300. Furthermore, the support element 400 may be product and model-specific, while the tray 300 and sleeve 200 may be more universal so that a single tray 200 and sleeve 300 configuration may be designed to accommodate differently sized product models that are fixed into position within the tray 300 with a correspondingly dimensioned support element 400. Manufacturing process can be simplified and inventory can be reduced by use of such a modular packaging system.

Figure 6:
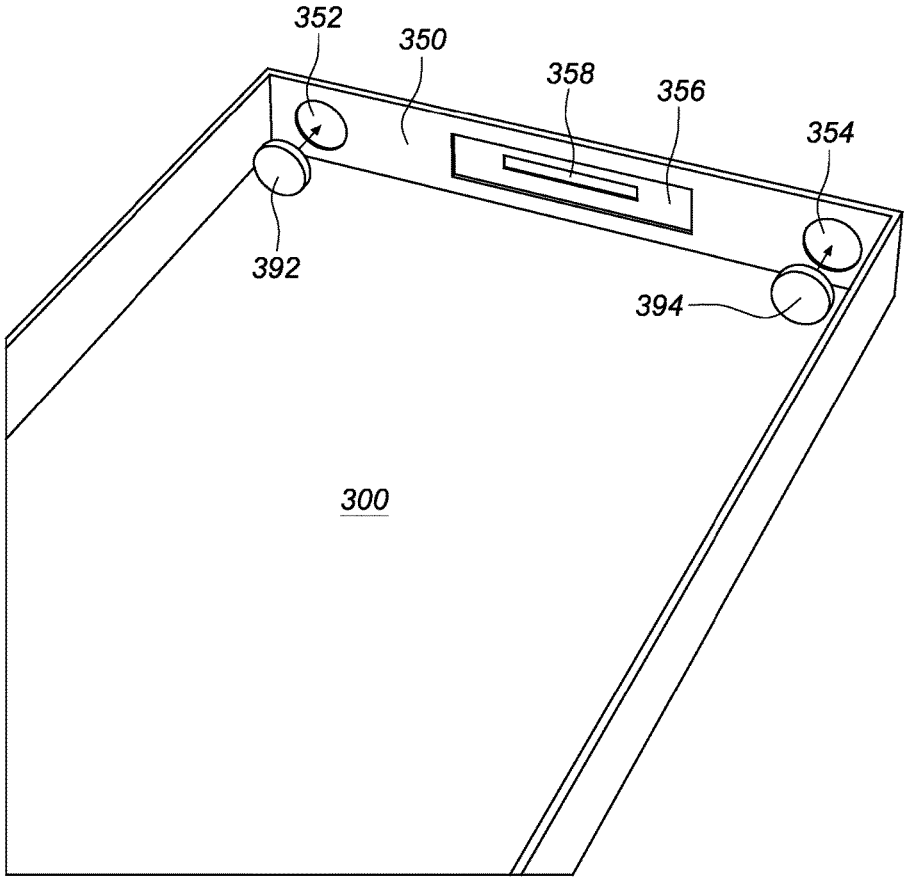
FIG. 6 illustrates the positioning of magnets within recessed formed in the top panel of the tray component illustrated in FIG. 1A.

The top walls 250, 350 of the sleeve and tray, respectively, can include magnets that have opposite polarization so as to attract one another. In the implementation illustrated, the top sleeve walls 250 includes two circular cavities with one positioned nearer the right sleeve wall 240 and the other positioned nearer the left sleeve wall 230. Residing within each cavity are magnetic attractive elements 292, 294, respectively, for attracting magnetic elements 392, 394 that are positioned in corresponding cavities in the top tray wall 350 of the tray 300 as best illustrated in FIG. 6. In one embodiment, the magnetic attractive elements 292, 294 are metal. Alternatively, magnetic attractive elements 292, 294 can have a first polarization (positive or negative) that are opposite to the polarization of the magnetic elements 392, 394 that are positioned in corresponding cavities in the top tray wall 350 of the tray 300.

Thus, when the tray 300 is inserted into the sleeve 200 the magnetic elements in the tray are in sufficient proximity and aligned with the overlying magnetic elements of the sleeve 200 they magnetically attract one another to thereby bias the tray 300 into a fully closed position within the sleeve 200. It should be understood that while two magnetic elements may be employed, it is contemplated that one of the opposing magnetic elements may be replaced with a ferrous metal element. It should be understood that one or more of the magnetic elements 292, 294, 392, 394 may be in the form a magnetic tape and/or magnetized metallic object and may be hidden or concealed partially or fully within the supporting walls in which they are mounted so as to be hidden from visibility.

In operation, when the user (e.g., customer or sales person) removes the tray 300 from the sleeve 200, the user will need to exert sufficient force to overcome the magnetic attraction between the two components. Alternatively, when the user reinserts the tray 300 in the sleeve 200, for example after inspecting the product, the magnetic attraction between the upper extents of the sleeve 200 and tray 300 magnetically draws the sleeve 200 quickly into the fully closed position, as if the sleeve was magically snapped into the fully closed position, thereby conveying an unique and unexpected "anti-gravity" experience to the customer. The magnetic attraction between the tray and sleeve components 200, 300 further serves to maintain the package 100 in the closed position even when the package is not hung on a display.

Since magnetic attraction between the sleeve and tray is employed to maintain the tray in the sleeve in the full closed position (as opposed to the frictional force employed in conventional packages), the outer dimensions of the sleeve component 200 can therefore be manufactured with less precision relative to the inner dimensions of the sleeve compartment 270 and thereby ease manufacturing processes and reduce manufacturing costs. In addition, because tolerances between the tray 300 and the sleeve 200 can be decreased (i.e., less mechanical friction), a smoother transition can be achieved when opening and closing the package 100.

The tray and sleeve components 300, 200 may be formed of any suitable material, and formed with any suitable manufacturing process including, for example, formed of injected molded polymer, fiber reinforced polymer, paper, or composite materials. Each component may be formed using the same manufacturing process and material or different manufacturing process and materials.

Figure 3A:
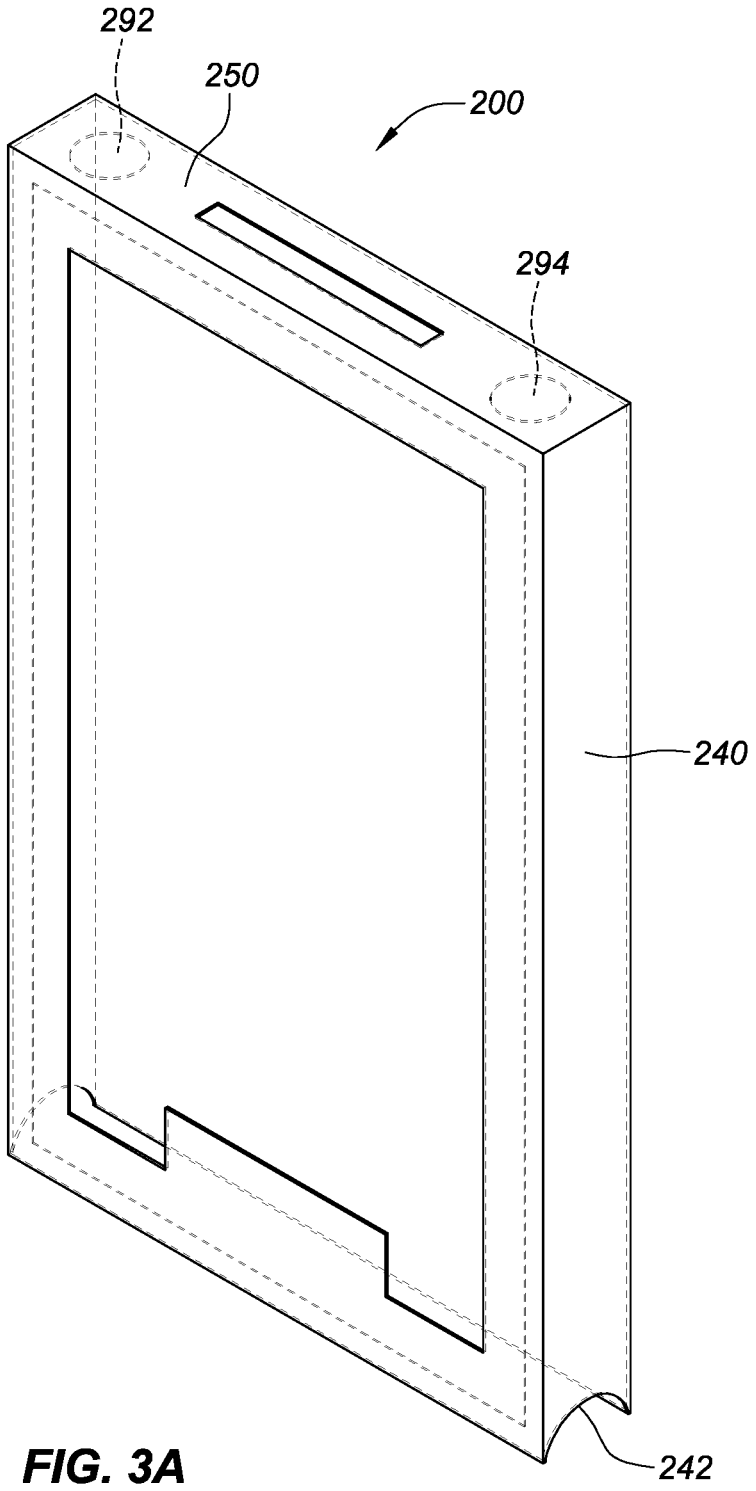
FIGS. 3A-3F are the perspective, front, left, right, top and bottom views, respectively, of the outer sleeve component of the multi-component package illustrated in FIG. 1A with the tray component been removed, wherein the dash-lines depict the concealed internal edges and corners of the wall of the sleeve.
Figure 3B:
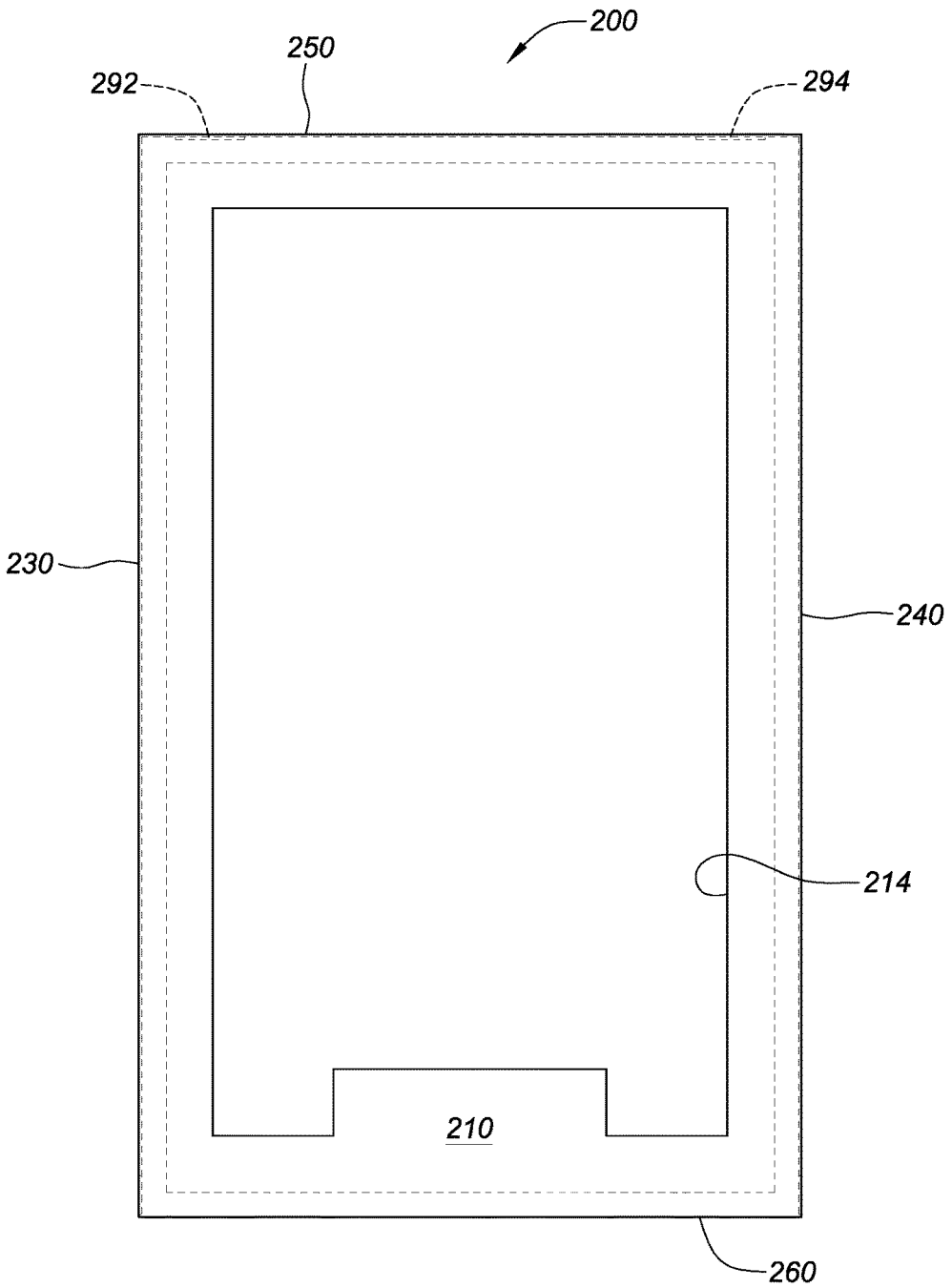
Figure 3C:
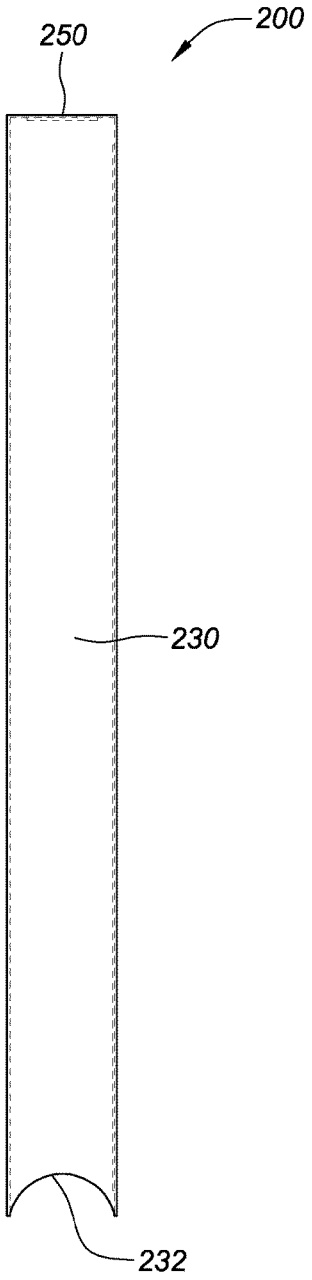
Figure 3D:
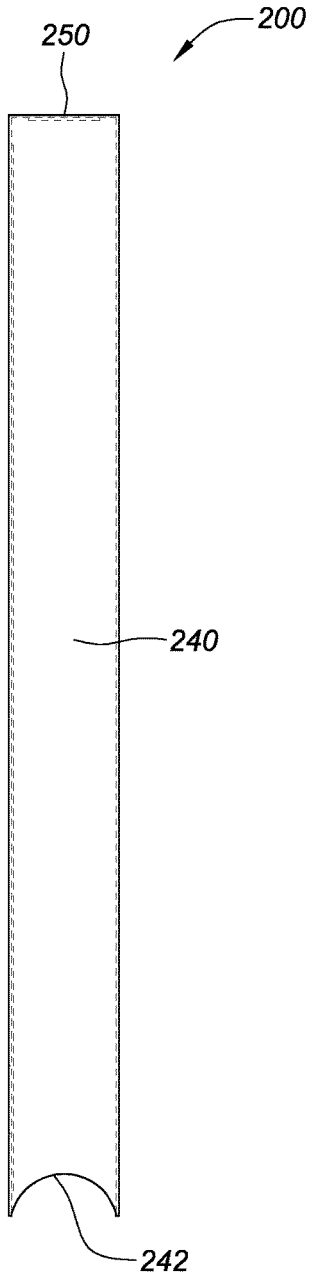
Figure 3E:
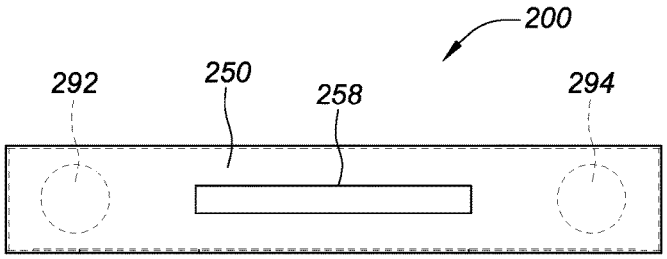
Figure 3F:
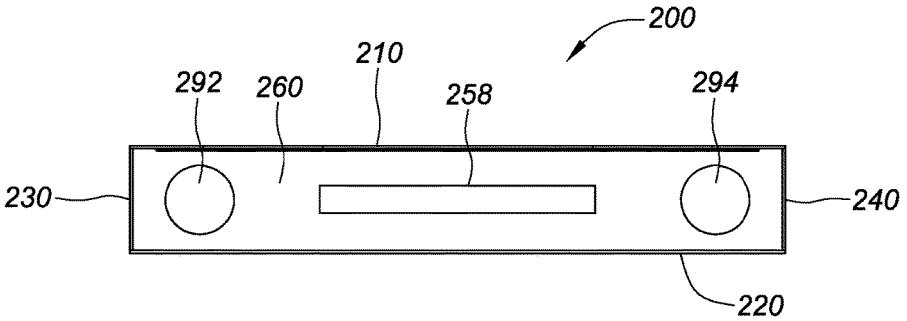
Figure 3G:
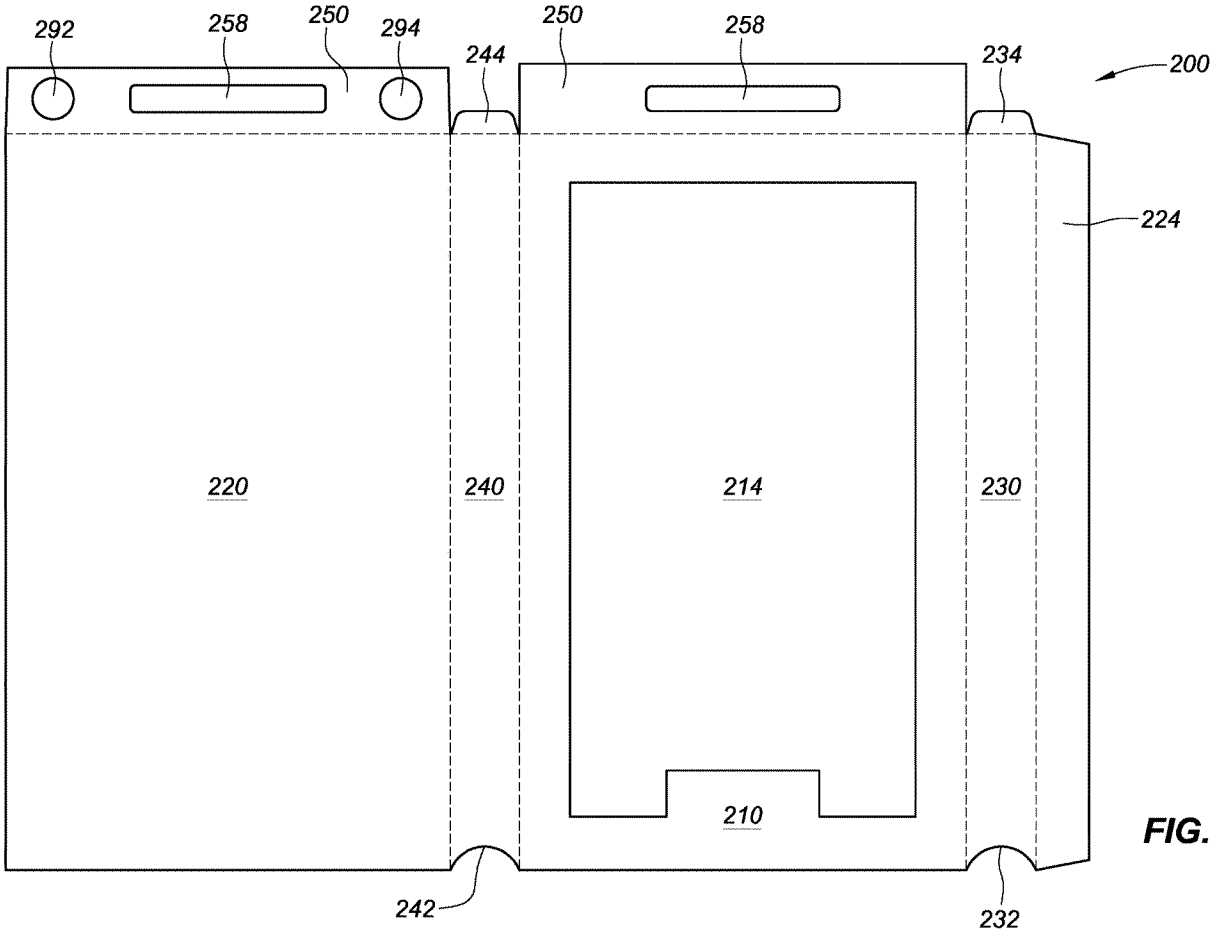
FIG. 3G illustrates the outer sleeve component of FIG. 1A unfolded into a single plane to illustrate the layout of the sleeve for manufacture from a planar sheet of material, with the dash lines representing the fold-lines.
Figure 4A:
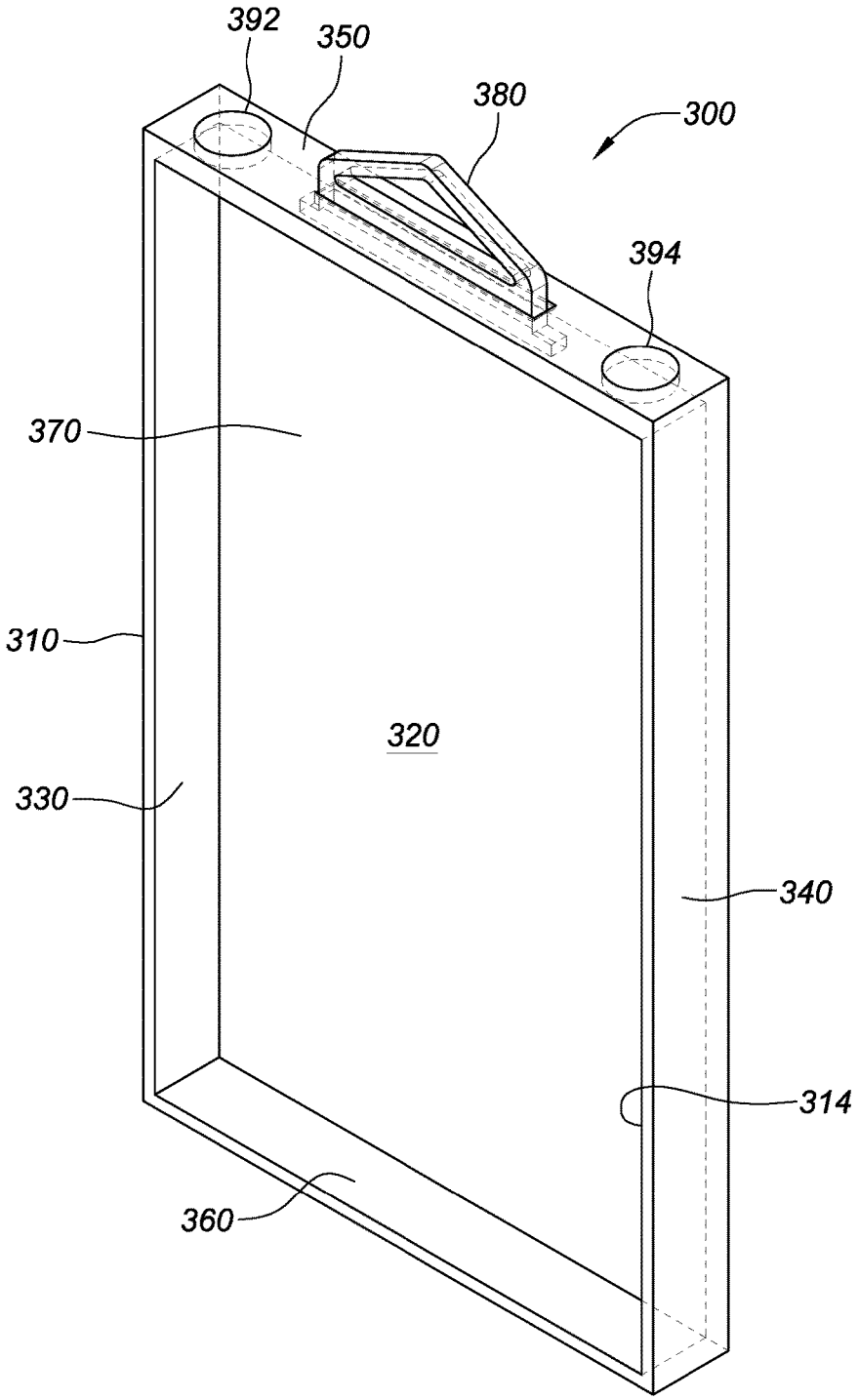
FIGS. 4A-4F are illustrations of perspective, front, left, right, top and bottom views, respectively, of the inner tray component of the multi-component package illustrated in FIG. 1A removed from the sleeve component, wherein the dash-lines depict the concealed internal edges and corners of the wall of the inner tray.
Figure 4B:
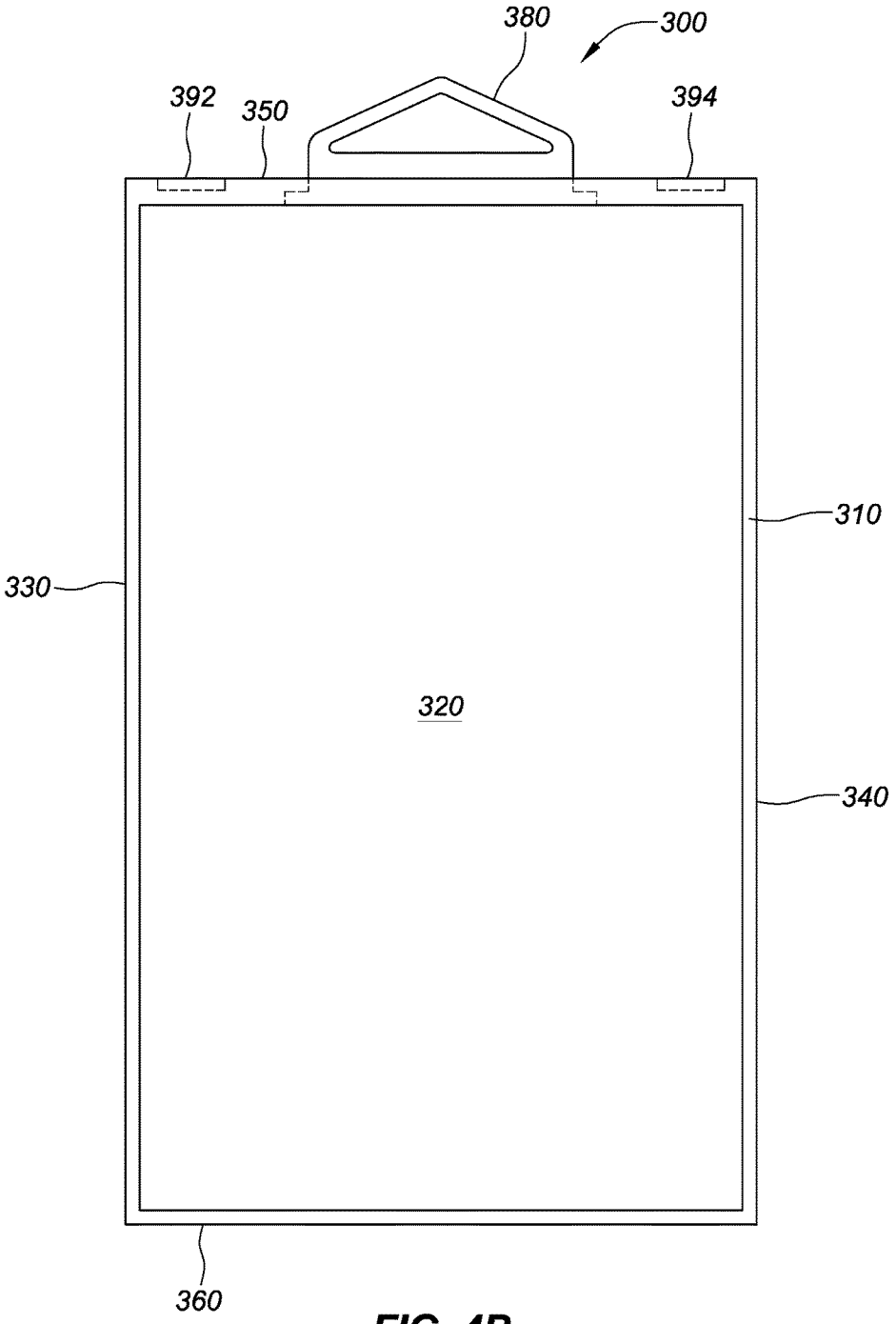
Figure 4C:
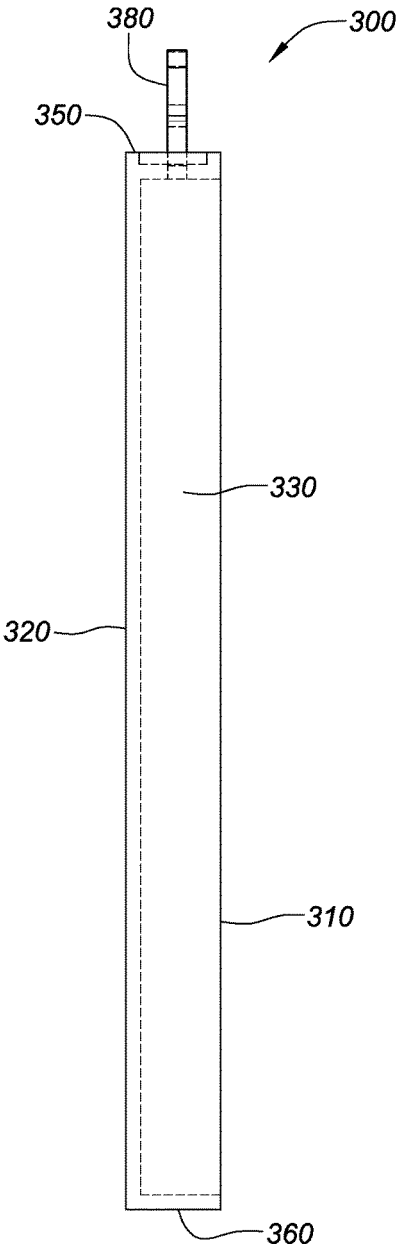
Figure 4D:
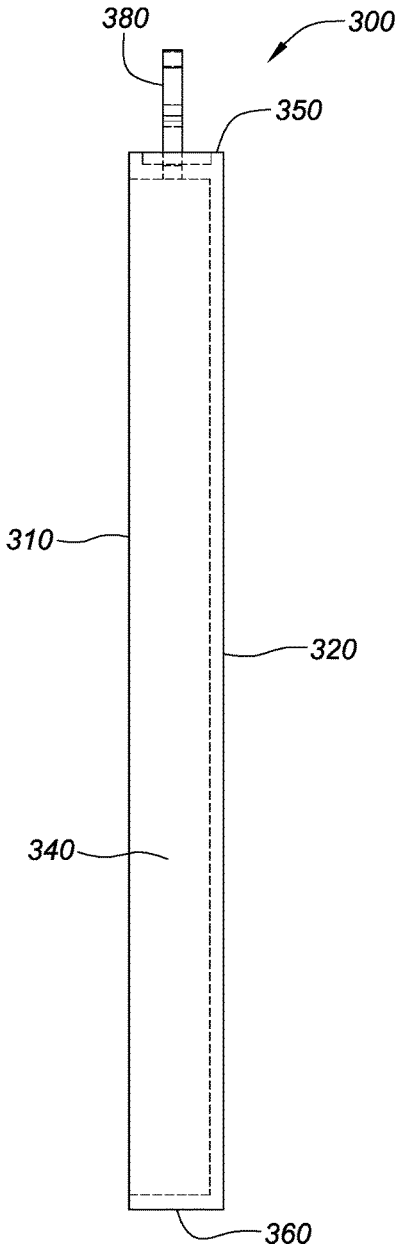
Figure 4E:
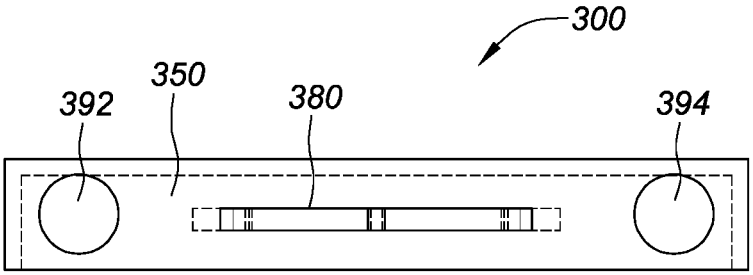
Figure 4F:
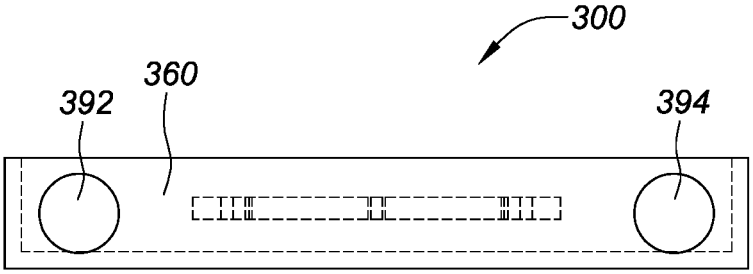
Figure 4G:
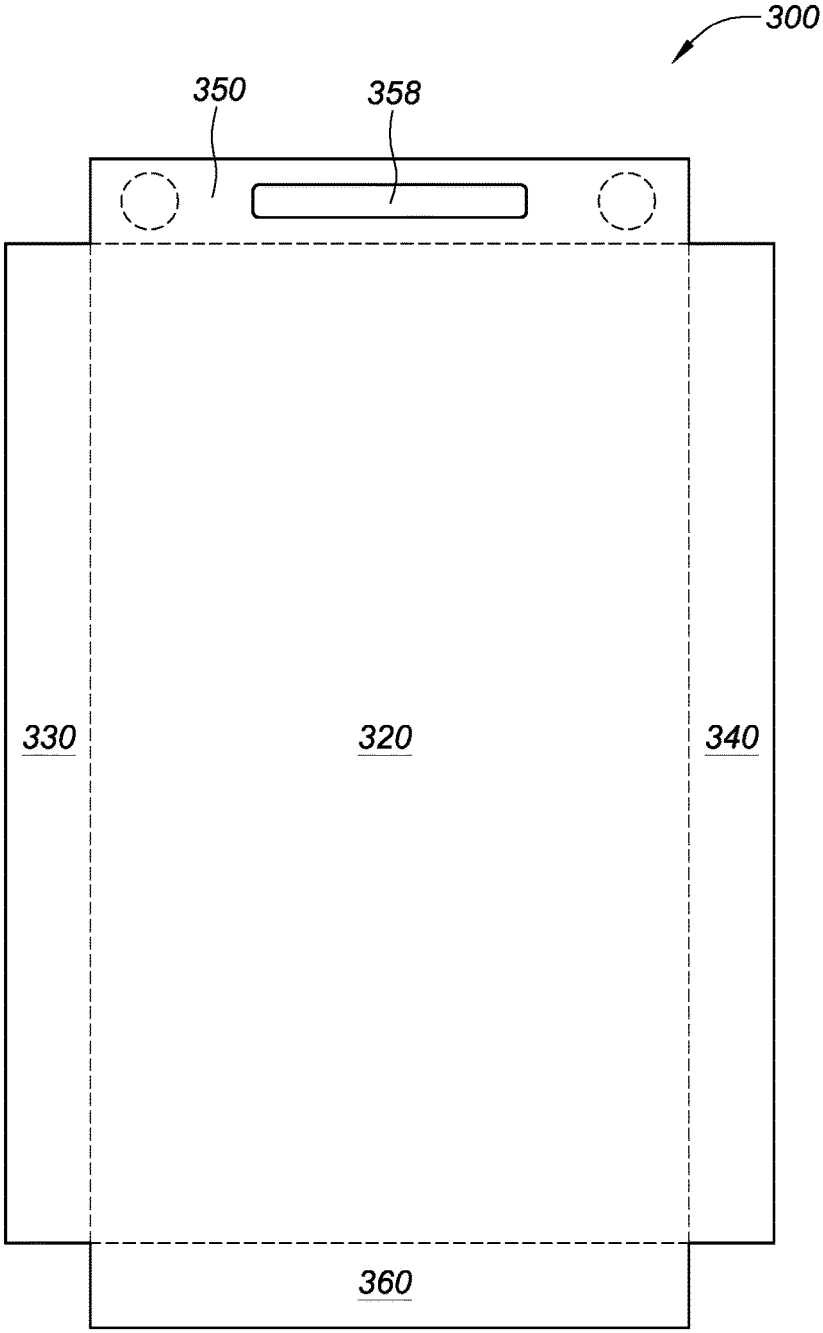
FIG. 4G illustrates the inner tray of FIG. 1A (without the hook attached thereto) unfolded into a single plane to illustrate the layout of the sleeve for manufacture from a planar sheet of material, with the dash lines representing the fold-lines.
Figure 5A:
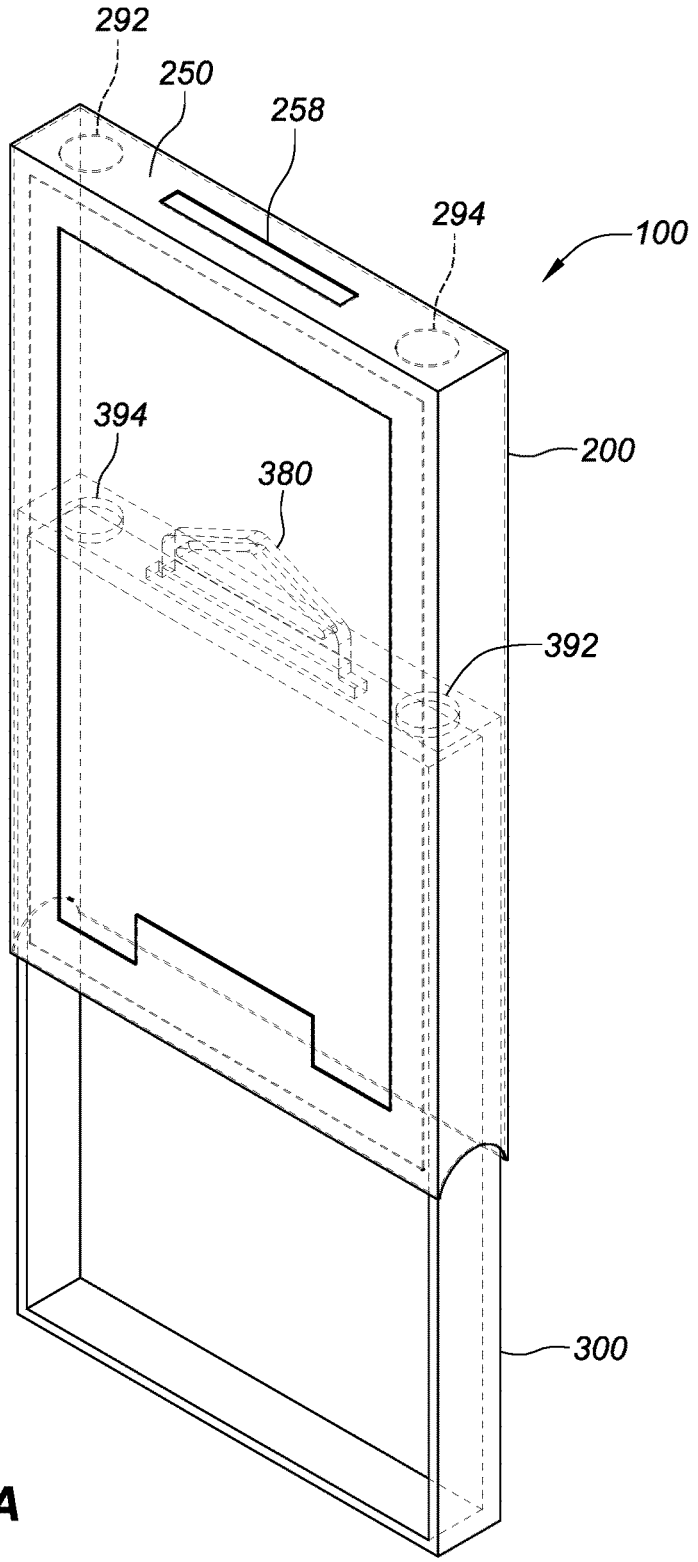
FIGS. 5A-5F are illustrations of perspective, front, left, right, top and bottom views, respectively, of the multi-component package of FIG. 1A with the tray component, as illustrated in FIGS. 4A-4F, being partially removed from the sleeve component, as illustrated in FIGS. 3A-3F.
Figure 5B:
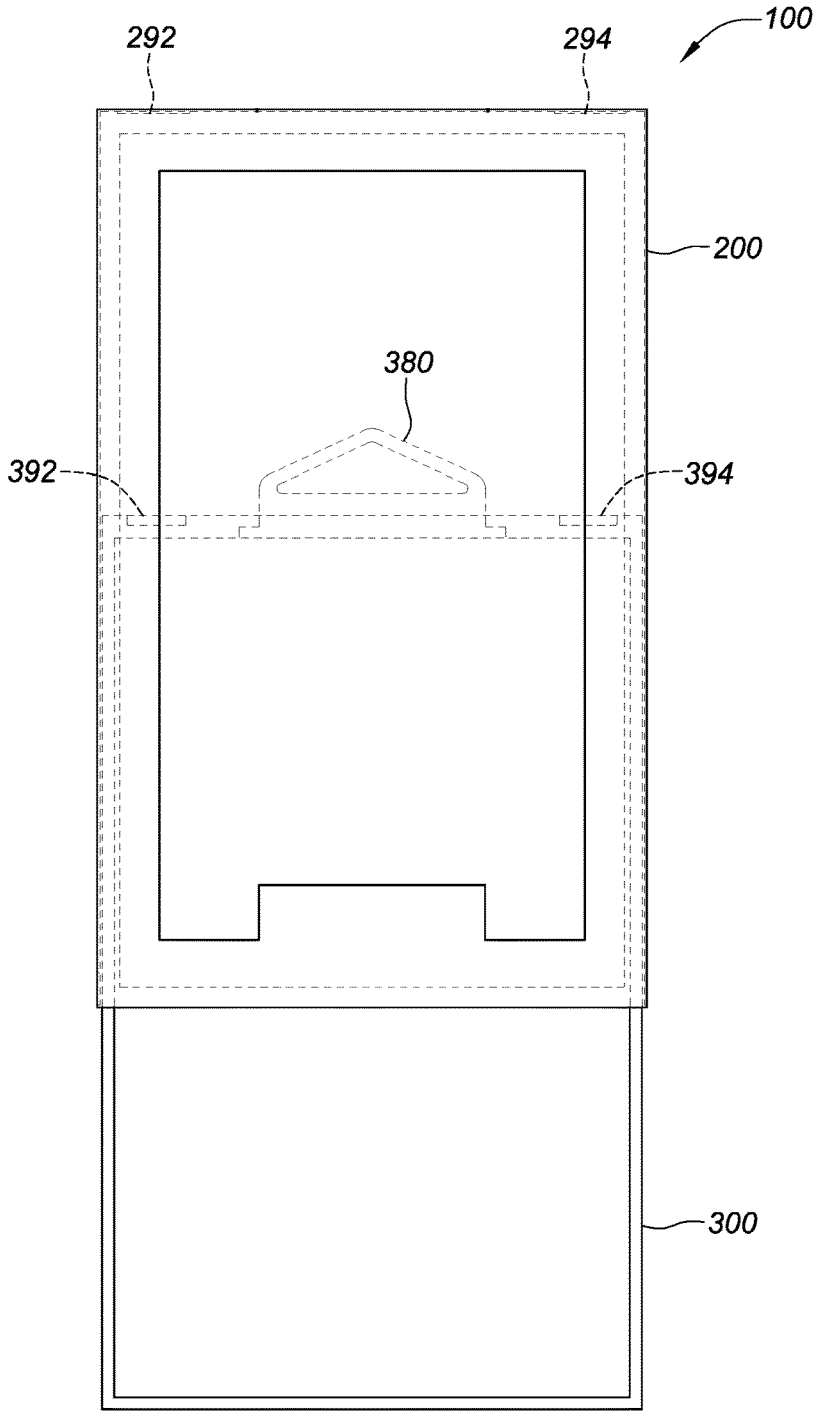
Figure 5C:
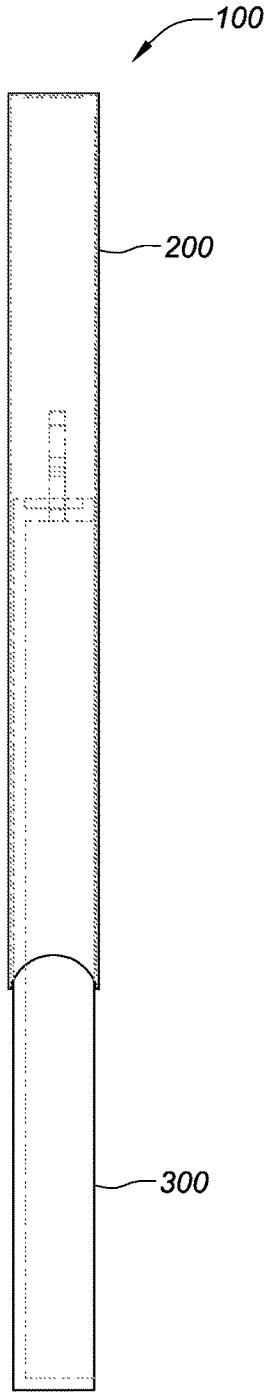
Figure 5D:
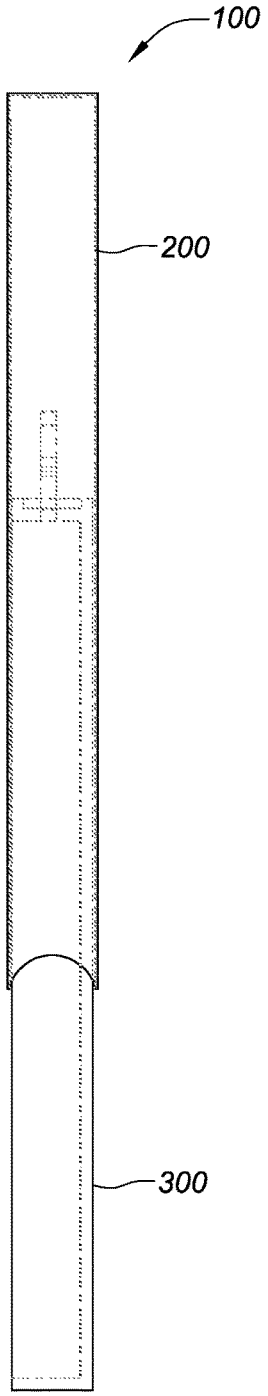
Figure 5E:
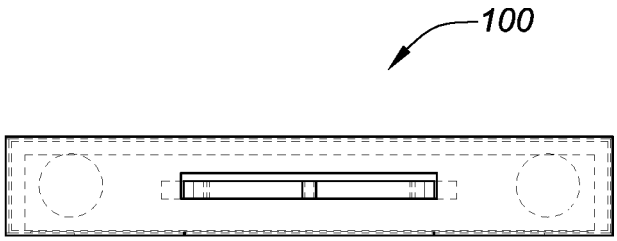
Figure 5F:
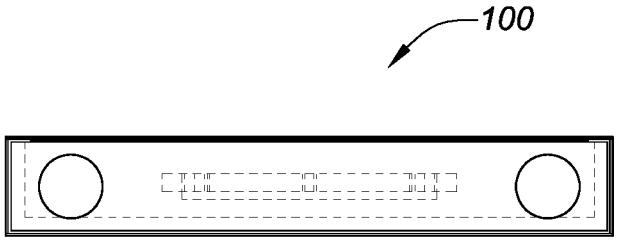

With reference to FIGS. 3G and 4G, in one implementation the tray and sleeve components 300, 200 are formed using a planar material that is template (by any suitable cutting means) with a pattern or layout, such as those depicted in FIGS. 3G and 4G. After being templated, the planar material can be folded along the fold lines (denoted as dash-lines in FIGS. 3G and 4G) to form the respective 3-dimensional tray and sleeve components 200, 300. When the sleeve 200 is folded as shown in FIGS. 3A-3F, flaps 234 and 244 (shown in FIG. 3G) can be attached to the top sleeve wall 250, while flap 224 can be attached to the rear sleeve wall 220. It should be understood that the number and dimensions of flaps may increase or decrease, as appropriate. As such, the discussion regarding the flaps should not be construed to limit the number or shape of the flaps. Moreover, although the exemplary illustrated implementation is discussed in relation to a specified number and configuration of wall panels it is within the scope of the present disclosure for the configuration and number of panels to increase or decrease depending on the overall configuration of the sleeve and tray. Also, the shape of the panels may be modified to reflect the desired shape of the package. Thus, while the illustrated packaging implementation is in the form of a rectangle it should be understood that the package may be square, triangular, trapezoidal, circular or cylindrical as desired.

The foregoing description has described embodiments with magnets and attractive elements and combinations thereof. It should be understood that magnets and attractive elements are only exemplary engaging mechanisms between the tray 300 and the sleeve 200. Accordingly, the concepts of this disclosure can include any other engaging mechanisms, for example, fabric hook and loop type fasteners such as those marketed under the Velcro® brand. In one implementation, one or more opposing pairs of magnets or ferrous elements, may be replaced with Velcro® type elements and thereby secure the package 100 in closed position. In such an implementation, the Velcro® type elements may be applied on the outer surface of the top tray wall 350 of the tray 300 and the inner surface of the top sleeve wall 250 of the outer sleeve 200.

The package 100 may also include a locking mechanism (not shown) configured to mechanically stop the tray 300 from being fully removed from the sleeve 200 component so as to avoid separation of the two components. The locking mechanism may be provided on one or more of the internal surfaces of the sleeve walls near the bottom side 260 of the sleeve 200 and interact with an engaging component located on the external surfaces of the tray 300 near the top end region of the tray 200. For example, the mechanical stop may be comprised of a latch or cavity that engages with a protrusion formed on the overlapping corresponding regions of the sleeve and tray when the package is in an open position.

Although various aspects are herein disclosed in the context of certain preferred embodiments, implementations, and examples, it will be understood by those skilled in the art that the present invention extends beyond the specifically disclosed embodiments to other alternative embodiments and/or uses of the inventive aspects and obvious modifications and equivalents thereof. In addition, while a number of variations of the aspects have been noted, other modifications, which are within their scope, will be readily apparent to those of skill in the art based upon this disclosure. It should be also understood that the scope this disclosure includes the various combinations or sub-combinations of the specific features and aspects of the embodiments disclosed herein, such that the various features, modes of implementation and operation, and aspects of the disclosed subject matter may be combined with or substituted for one another. Thus, it is intended that the scope of the present invention herein disclosed should not be limited by the particular disclosed embodiments or implementations described above, but should be determined only by a fair reading of the claims.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A multi-component package for a product comprising:

an outer sleeve component comprising a front sleeve wall that defines the front side of the sleeve component, an opposing rear sleeve wall that defines the back side of the sleeve component, left and right opposing sleeve walls that define left and right sides of the sleeve component, a top sleeve wall that defines the top side of the sleeve component and an opposing bottom side of the sleeve component that includes an opening to a sleeve compartment that is defined by the walls of the sleeve component;

an inner tray component being comprised of a front tray wall that defines a front side of the tray component, an opposing rear tray wall that defines the back side of the tray component, left and right opposing tray walls that define left and right sides of the tray component, a top tray wall that defines the top side of the tray component and an opposing bottom tray wall that defines the bottom side of the tray component with the internal surfaces of the tray walls defining a tray compartment configured to receive a product positioned therein; and a product support component positioned within the tray compartment and is configured to detachably connect to the product and fixedly position the product within the tray component so that the product is not in contact with any of the tray walls, wherein the inner tray component is dimensioned to slide in and out of the sleeve compartment via the opening in the bottom side of the sleeve component from a fully closed position, where the top sleeve wall and the top tray wall are in contact with one another, to an open position, where the top sleeve wall and the top tray wall are displaced from one another, and wherein the top sleeve wall and top tray wall being configured to be fastened to one another with an engaging mechanism disposed thereon.

2. The package of claim 1, wherein the top sleeve wall includes a first magnetic element with a first polarization and the top tray wall includes a second magnetic element with a second polarization that is opposite to the first polarization and positioned such that the first and second magnetic elements are magnetically attracted to each other when the tray component is in the fully closed position.

3. The package of claim 1, wherein the top sleeve wall includes a first magnetic element with a first polarization and the top tray wall includes a ferrous metallic element that is configured to be magnetically attracted to the first magnetic element and positioned such that the ferrous metallic element is magnetically attracted to the first magnetic element when the tray component is in the fully closed position.

4. The package of claim 1, wherein the top sleeve wall includes first and second magnetic elements each having a first polarization and the top tray wall includes a third and fourth magnetic element each having a second polarization and being positioned such that the first and third magnetic elements are magnetically attracted to each other when the tray component is in the fully closed position and the second and fourth magnetic elements are magnetically attracted to each other when the tray component is in the fully closed position.

5. The package of claim 4, wherein the first magnetic element is positioned nearer the left sleeve wall than the second magnetic element.

6. The package of claim 4, wherein the first magnetic element and second magnetic element are spaced apart with the first magnetic element being positioned a first distance from left sleeve wall and the second magnetic element being positioned a second distance from the right sleeve wall and the first and second distances being the same.

7. The package of claim 4, wherein the first magnetic element and second magnetic element are spaced apart with the first magnetic element being positioned a first distance from left sleeve wall and the second magnetic element being positioned a second distance from the right sleeve wall and the first and second distances being different.

8. The package of claim 1, wherein the front side of the sleeve component includes a window.

9. The package of claim 1, wherein the front side of the sleeve component includes a covered window that is formed of a material that allows for visibility into the sleeve compartment.

10. The package of claim 1, wherein the front side of the sleeve component includes a covered window that is formed of a transparent polymer panel that is mounted to the internal surface of the front sleeve wall.

11. The package of claim 9, wherein the front side of the tray component includes a window.

12. The package of claim 1, wherein the front side of the tray component includes a window.

13. The package of claim 1, wherein the front side of the tray component includes a covered window.

14. The package of claim 1, wherein the top tray wall includes a hook component extending outwardly therefrom and wherein the top sleeve wall includes an aperture that is dimensioned to allow the hook component to pass therethrough when the tray component is being slid into the sleeve component toward the fully closed position.

15. The package of claim 14, wherein the hook component includes a tab and an extended portion, the tab being mounted to the internal side of the top tray wall and extended portion passing through an aperture in the top tray wall and being configured to hang on a display peg.

16. The package of claim 1, wherein the sleeve component is formed of a first material and the tray component is formed of a second material different than the first material.

17. The package of claim 2, wherein the first and second magnetic elements are concealed within the package.

18. The package of claim 1 further including a mechanical stop configured to mitigate against the tray component being separated from the sleeve component.

19. The package of claim 1, wherein the top sleeve wall and the top tray wall attracted to each other with fabric hook and loop type fasteners when the tray component is in the fully closed position.

20. A multi-component package for a product comprising:

an outer sleeve component comprising a front sleeve wall that defines the front side of the sleeve component, an opposing rear sleeve wall that defines the back side of the sleeve component, left and right opposing sleeve walls that define left and right sides of the sleeve component, a top sleeve wall that defines the top side of the sleeve component and an opposing bottom side of the sleeve component that includes an opening to a sleeve compartment that is defined by the walls of the sleeve component;

an inner tray component being comprised of a front tray wall that defines a front side of the tray component, an opposing rear tray wall that defines the back side of the tray component, left and right opposing tray walls that define left and right sides of the tray component, a top tray wall that defines the top side of the tray component and an opposing bottom tray wall that defines the bottom side of the tray component with the internal surfaces of the tray walls defining a tray compartment configured to receive a product positioned therein; and a mechanical stop configured to mitigate against the tray component being separated from the sleeve component, wherein the inner tray component dimensioned to slide in and out of the sleeve compartment via the opening in the bottom side of the sleeve component from a fully closed position, where the top sleeve wall and the top tray wall are in contact with one another, to an open position, where the top sleeve wall and the top tray wall are displaced from one another, and wherein the top sleeve wall and top tray wall being configured to be magnetically attracted to one another with one or more magnetic elements disposed thereon.

21. The package of claim 20 further including a product support component positioned within the tray compartment and is configured to detachably connect to the product and fixedly position the product within the tray component so that the product is not in contact with any of the tray walls.

* * * * *